175-40 SR
7/20/76 XR 3,970,877

United States Patent [19]
Russell et al.
[11] 3,970,877
[45] July 20, 1976

[54] POWER GENERATION IN UNDERGROUND DRILLING OPERATIONS

[76] Inventors: Michael King Russell, 3, Culross Close; Anthony William Russell, 265, Old Bath Road, both of Cheltenham, England

[22] Filed: Aug. 30, 1974

[21] Appl. No.: 502,227

[30] Foreign Application Priority Data

Aug. 31, 1973 United Kingdom ..... 40989/73

[52] U.S. Cl. ..... 310/8.3; 73/194 B; 73/194 C; 175/40; 175/48; 310/8.7; 310/9.1; 310/8.5

[51] Int. Cl.[2] ..... H01L 41/10

[58] Field of Search ..... 310/8.1, 8.2, 8, 8.3, 310/8.5, 8.6, 8.7, 9.1, 9.4; 175/40, 48, 26; 73/151, 516 LM, 488, 494, DIG. 4, 194 R, 194 A, 194 B, 194 C; 340/8, 10, 18, 239 R; 322/1

[56] References Cited

UNITED STATES PATENTS

| | | | |
|---|---|---|---|
| 2,848,710 | 8/1958 | Owen | 175/48 X |
| 2,963,099 | 12/1960 | Gianelloni, Jr. | 175/26 X |
| 2,964,116 | 12/1960 | Peterson | 175/48 |
| 3,627,065 | 12/1971 | Murphy | 175/48 |
| 3,789,935 | 2/1974 | Saadeh | 175/40 |
| 3,800,277 | 3/1974 | Patton et al. | 175/26 X |
| 3,821,726 | 6/1974 | Chang et al. | 175/48 X |

*Primary Examiner*—Mark O. Budd
*Attorney, Agent, or Firm*—Young & Thompson

[57] ABSTRACT

The electrical power required to drive downhole drilling tools and/or measuring instruments is obtained using means responsive to turbulence in the mud flow past a unit forming part of the drill string. The responsive means may comprise a piezo-electric disc connected to rectifying and smoothing circuits whereby a D.C. output is obtained.

3 Claims, 1 Drawing Figure

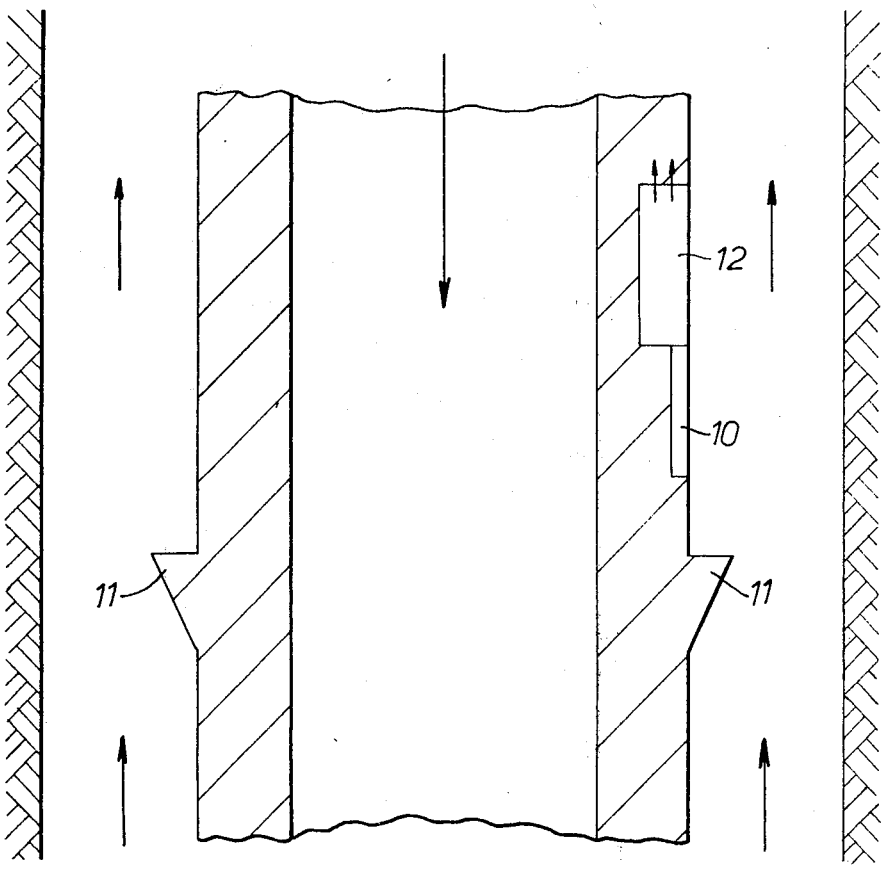
12
10
11
11

POWER GENERATION IN UNDERGROUND DRILLING OPERATIONS

This invention relates to power generation in underground drilling operations.

The electrical power required to drive down-hole drilling tools and/or measuring instruments can be derived from a surface power supply, from a down-hole battery pack or from some other form of down-hole power supply. If a surface power supply is used, many problems are encountered, particularly when running a supply cable into and out of the hole at each tool run. If a down-hole battery pack is used, battery failure at prolonged high temperatures is quite likely and this is an extremely serious limitation preventing reliable operation of the tools and/or measuring instruments.

At the present time, a number of proposals of down-hole power generation are being investigated and these generally include the use of a turbine generator. Although the use of a turbine generator is satisfactory for the generation of comparatively large power supplies, it is not generally suitable for the generation of low wattages.

It is accordingly an object of the invention to provide a method of generating power for use in underground drilling operations which is applicable to low-power generation. The invention is based on the appreciation of a requirement for a low-power generator which can form part of the drill string and can be left in place for long periods of time.

According to the invention, power generation is effected using means responsive to turbulence in the mud flow past a unit forming part of the drill string. Such responsive means may include a vibratory flexible disc arranged in the unit so as to form part of the surface thereof and to vibrate as a result of turbulent flow of mud past the unit, means being provided for converting vibrational movement of the disc into an electrical output.

Said conversion means may comprise a fixed coil with a magnetic core freely movable relative to the coil and attached to the inner surface of the flexible disc. However, said conversion means is preferably in the form of a layer of piezo-electric material bonded to one side of the flexible disc. As a further alternative, the flexible disc may itself be of a piezo-electric material and thus obviating any requirement for separate means.

The electrical output derived from the piezo-electric element will be in the form of high-voltage pulses associated with the random noise pattern of the turbulent mud flow. Electronic devices will be associated with the piezo-electric element to rectify and smooth the output obtained from the element to obtain a D.C.

output. If desired, projecting means may be associated with the unit and arranged to induce additional turbulence in the mud flow. In many cases, however, the turbulence generated during drilling will itself be sufficient to induce sufficient vibrational movement of the flexible disc.

The invention will now be described by way of example with reference to the single FIGURE of accompanying drawing which illustrates in diagrammatic form a unit forming part of a drill string for use in underground drilling operations.

The unit is of tubular form and a part of the surface of the unit is rebated to provide a seating for a flexible disc 10. The flexible disc 10 may be a disc of piezo-electric material. Alternatively the disc is of some other material, for example, a wear-resistant material and has a disc or plate of piezo-electric material bonded to its inner surface.

The rebate in which the disc 10 is received is situated a short distance above a rib formation 11 projecting outwardly of the tubular unit and the rib formation acts to induce additional turbulence in the mud flow past the disc 10. The disc 10 is thus caused to vibrate and generate an electrical output. The output obtained from the disc comprises short-duration high-voltage pulses and these are passed to electronic devices 12 constituting rectifying and smoothing circuits whereby a D.C. output is obtained. The D.C. output is used to operate tools and measuring instruments.

What is claimed is:

1. A method of generating electrical power in underground drilling operations which involve the flow of mud past a hollow drill string, said method comprising providing a hollow unit forming part of the hollow drill string, said unit including a vibratory flexible element forming part of the outer surface of the unit so as to be distorted by turbulence in said mud flow and means for producing an electrical voltage in response to distortion of said flexible element, wherein vibration of the flexible element results in the production of an output comprising high-voltage pulses and wherein electronic devices are provided to rectify and smooth said output, providing a projection on the outer surface of said unit below said flexible element, and flowing mud down through the inside of said hollow unit and up past the outside of said hollow unit past said projection and then past said flexible element whereby said projection creates turbulence that distorts said flexible element.

2. A method according to claim 1, wherein the flexible element is of piezo-electric material.

3. A method according to claim 1, wherein the flexible element has a layer of piezo-electric material bonded to it.

* * * * *